United States Patent [19]

Birmingham et al.

[11] 4,444,735

[45] Apr. 24, 1984

[54] THERMAL OXIDIZER AND METHOD FOR OPERATING SAME

[75] Inventors: James W. Birmingham, Wellsville; Craig R. Johnson, Cuba, both of N.Y.

[73] Assignee: The Air Preheater Company, Inc., Wellsville, N.Y.

[21] Appl. No.: 418,498

[22] Filed: Sep. 15, 1982

[51] Int. Cl.[3] ..... B01D 53/34; F23G 7/06

[52] U.S. Cl. ..... 423/210; 110/187; 110/345; 422/111; 422/173; 422/183; 431/5

[58] Field of Search ..... 423/210; 422/111, 112, 422/173, 183; 431/2, 5, 11; 110/186–188, 344, 345

[56] References Cited

U.S. PATENT DOCUMENTS

| | | | |
|---|---|---|---|
| 3,090,675 | 5/1963 | Ruff et al. | 423/210 X |
| 3,251,656 | 5/1966 | Edwards | 422/183 |
| 3,353,919 | 11/1967 | Stockman | 423/210 X |
| 3,607,118 | 9/1971 | Johnson | 422/173 |
| 3,993,449 | 11/1976 | Childs | 422/183 |

*Primary Examiner*—Earl C. Thomas

*Attorney, Agent, or Firm*—William W. Habelt

[57] ABSTRACT

A fume incinerator (10) and a method of operating same for eliminating combustible fumes from an oxygen bearing process gas stream (1). A first portion (11) of the oxygen bearing process gas (1) is passed to a burner (30) and serves as the source of oxygen for combusting an auxiliary fuel (9) to establish a flame front (28) within the incinerator. The remainder (13) of the process gas stream (1) is passed through the flame front for incineration of any obnoxious fumes contained therein.

7 Claims, 1 Drawing Figure

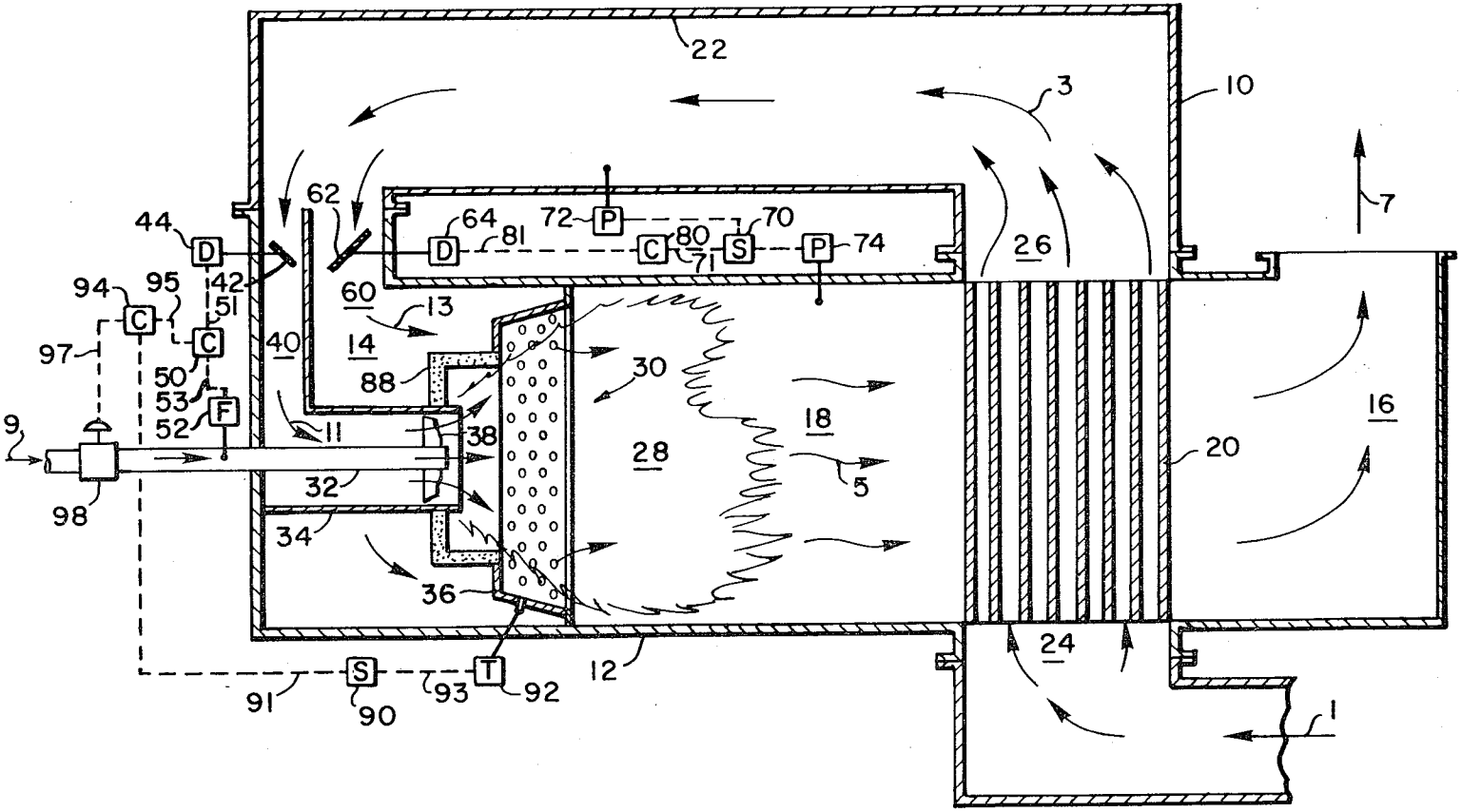
7
16
1
10
20
3
26
24
22
74
P
70
S
80
71
C
72
P
81
64
D
18
5
30
28
12
92
T
93
90
S
91
13
60
14
88
38
36
62
11
32
34
40
42
51
D
44
C
95
C
94
50
53
52
F
97
98
9

THERMAL OXIDIZER AND METHOD FOR OPERATING SAME

BACKGROUND OF THE INVENTION

The present invention relates to the incineration of obnoxious fumes contained in process gas streams, and more particularly, to a direct flame fume incinerator, and method for operating same, for incinerating an oxygen bearing process gas stream to eliminate obnoxious fumes contained within the process gas stream before the process gas stream is vented to the atmosphere.

The use of fume incinerators for combusting the off gases of various industrial processes in order to incinerate and eliminate obnoxious fumes contained therein is well known in the prior art. In one type of fume incinerator commonly utilized for this purpose, termed a thermal oxidizer, the process gas stream is oxygen bearing and serves as the source of oxygen for combusting an auxiliary fuel to establish a flame in which any obnoxious fumes are incinerated. Typically, the process gas stream is first preheated by being passed in heat exchange relationship with the combustion products of the fume incinerator as the process gas stream is being passed to the burners of the fume incinerator. By preheating the process gas stream prior to combustion, the overall efficiency of the combustion process is increased and the amount of fuel gas consumed in the combustion of the process gas stream is reduced. U.S. Pat. Nos. 3,251,656, 3,353,919 and 3,607,118 show fume incinerating apparatus of this type.

In order to incinerate the process gas stream, it is necessary to provide auxiliary fuel to the incinerator for establishing a flame front through which the process gas stream is passed in order to destroy any obnoxious fumes contained therein. As the process stream also serves as the source of oxygen for combustion of the fuel gas, good mixing between the fuel gas and the process gas stream must occur. It is also necessary that all of the process gas stream which was not mixed with the auxiliary fuel prior to establishment of the flame front be passed through the flame front in order to insure efficient elimination of obnoxious fumes contained in the process stream.

SUMMARY OF THE INVENTION

The present invention provides a fume incinerator, and a method of operating same, for eliminating combustible fumes from an oxygen bearing process gas stream by passing the process gas stream through a flame front established by combusting an auxiliary fuel. The oxygen bearing process gas stream also serves as the source of oxygen for combusting the auxiliary fuel.

The fume incinerator of the present invention is comprised of a housing defining therein a gas inlet plenum, a gas outlet plenum, and a combustion chamber therebetween, a process gas stream supply duct for conveying the process gas to be incinerated to the housing, and a burner assembly disposed axially within the housing between the inlet plenum and the combustion chamber.

The burner assembly is comprised of a central fuel pipe for feeding auxiliary fuel to the combustion chamber, a primary air conduit opening into the combustion chamber and disposed coaxially about the central fuel pipe, and a perforated mixing plate means disposed about the primary air conduit between the inlet plenum and the combustion chamber. A first gas inlet duct interconnects the supply duct to the primary air conduit for conveying a first portion of the process gas stream to the combustion chamber through the primary air conduit, and a second gas inlet duct interconnects the supply duct to the inlet plenum for conveying a second process gas stream to the combustion chamber through the perforated mixing plate means.

In accordance with the present invention, first flow control means are provided for regulating the flow of process gas through the first gas inlet duct in response to the flow rate of auxiliary fuel so as to control the ratio of fuel flow to the first portion of the process gas stream, and second flow control means are provided for regulating the flow of process gas through the second gas inlet duct in response to the difference in gas pressure between the process gas stream supply duct and the combustion chamber so as to maintain constant static pressure differential therebetween.

Additionally, temperature sensing means may be provided for sensing the surface temperature of the mixing plate means and generating an override control signal for causing the first flow control means to increase the flow of the first portion of the process stream to the primary air conduit of the burner assembly whenever an upper temperature limit is reached.

In the method of operating the fume incinerator of the present invention, the process gas stream to be incinerated is split into a first and a second portion. The first portion is passed into the combustion chamber so as to mix with the auxiliary fuel being fed to the combustion chamber thereby establishing a flame front within the combustion chamber, and the second portion is passed into the combustion chamber from the gas inlet plenum through the perforated mixing plates means so as to pass through the flame front.

In accordance with the present invention, the flow rate of the first portion of the process gas stream is controlled in response to fuel feed rate, and the flow rate of the second portion of the process gas stream is controlled in response to the difference in pressure between a location in the process gas stream prior to splitting the process gas stream and a location in the combustion chamber so as to maintain a constant static pressure differential therebetween.

In a further aspect of the method of the present invention, the surface temperature of the mixing plate means of the burner assembly is compared to a first and a second upper temperature limit, the second limit being at a higher temperature than the first limit. Whenever the sensed temperature reaches the first limit, the flow of the first portion of the process gas stream through the primary air conduit of the burner assembly is allowed to increase. If the sensed temperature continues to rise and reaches the second limit, the flow of auxiliary fuel to the combustion chamber is terminated.

BRIEF DESCRIPTION OF THE DRAWING

The sole FIGURE of the drawing is a side elevational view illustrating the direct flame fume incinerator of the present invention.

DESCRIPTION OF THE PREFERRED EMBODIMENT

Referring now to the drawing, there is depicted therein a fume incinerator 10 of the type wherein the off gas 1 from an industrial process, hereinafter referred to as the process gas stream, is passed directly through a flame front for incineration. The fume incinerator 10 is comprised of a housing 12 enclosing and defining a gas inlet plenum 14, a gas outlet plenum 16, and a combustion chamber 18 therebetween. Additionally, heat exchange means 20 may be disposed within the gas outlet plenum 16 to preheat process gas prior to incineration.

The process gas stream 1 containing the obnoxious fumes to be incinerated in the combustion chamber 18 is typically first passed to the incinerator 10 through the inlet 24 to the heat exchange means 20. As the process gas stream 1 traverses the heat exchange means 20, it is passed in indirect heat exchange relationship with the incinerated process gas 5 leaving the combustion chamber 18. The process gas 1 is thereby preheated whereby combustion efficiency is increased and the amount of fuel gas required to incinerate the process stream is decreased. The reheated process gas stream 3 passes from the heat exchange means 20 through outlet 26 thereof to a process gas supply duct 22. The supply duct 22 interconnects the outlet 26 of the heat exchange means 20 with the housing 12 of incinerator 10.

The preheated process gas stream 3 is then incinerated in combustion chamber 18 in the flame 28 thereby eliminating any obnoxious fumes contained in the process gas stream. As mentioned previously, the incinerated process gas 5 is passed through heat exchange means 20 in indirect heat exchange relationship with the process gas stream 1 being supplied to the incinerator so as to preheat the process gas stream being supplied to the incinerator and cool the incinerated process gas 5. The cool, incinerated process gas 7 then passes from the gas outlet plenum 16 and is vented to the atmosphere through a stack (not shown).

The flame front 28 by means of which the process gas is incinerated is generated by combusting an auxiliary fuel, usually natural gas, oil or other liquid fuel, via burner assembly 30 which is disposed axially within the housing 12 between the inlet plenum 14 and the combustion chamber 18. The burner assembly 30 is comprised of a central fuel pipe 32 through which auxiliary fuel 9 is fed to the combustion chamber 18, a primary air conduit 34 disposed coaxially about the central fuel pipe 32 and opening into the combustion chamber 18, and perforated mixing plate means 36 disposed about the primary air conduit 34 and forming an interface between the inlet plenum 14 and the combustion chamber 18.

In operation, the process gas stream 3 to be incinerated is passed to the housing 12 of the incinerator 10 through the gas supply duct 22. Upon entering the housing 12, the process gas stream is split into a first and a second portion. The first portion 11 of the process gas 3 is conveyed to the primary air conduit 34 of the burner assembly 30 thru a first gas inlet duct 40 which interconnects the gas supply duct 22 to the primary air conduit 34. The second portion 13 of the process gas 3 is conveyed into the inlet plenum 14 of the housing 12 through a second gas inlet duct 60 which interconnects the gas supply duct 22 to the inlet plenum 14.

The first portion 11 of the oxygen-bearing process gas stream 3 is mixed with auxiliary fuel 9 to establish the flame 28 within the combustion chamber 18. To ensure good mixing of the first process gas stream 11 with the auxiliary fuel 9, swirler vanes 38 are disposed at the outlet of the primary air conduit 34 to impart a vortex swirl to the first process gas stream 11 as it enters the combustion chamber 18 thereby causing the auxiliary fuel 9 discharging from fuel pipe 32 to be entrained in the oxygen bearing process gas stream 11. Additionally, a flame seat 88 may be provided about the outlet of the primary air conduit 34 to shield the process gas stream and fuel mixture from the second process gas stream 13 until stable ignition is achieved. In the preferred embodiment, the flame seat 88 comprises a cylindrical shell of refractory tile disposed coaxially about the outlet end of the primary air conduit 34 and extending axially therefrom to open into the combustion chamber 18.

The second portion 13 of the process gas stream 3 passes from the inlet plenum 14 into the combustion chamber 18 through the perforated mixing plate means 36 which establishes an interface between the inlet plenum 14 and the combustion chamber 18. The perforated mixing plate means 36 serves to direct the second portion 13 of the process gas stream 3 into the flame 28 for incineration. The holes in the perforated plate means 36 through which the second process gas stream 13 passes are spaced and sized to properly distribute and mix the process gas stream 13 into the flame 28.

The vortex swirl imparted to the first process gas stream 11 by swirler vanes 38 causes the second portion 13 of process gas stream 3 to pass through mixing plate means 36 and remix with the first portion 11 of process gas stream 3 at such a rate that flame quenching is prevented and obnoxious fumes in the process gas stream 3 incinerated. Penetration of the second portion 13 of process gas stream 3 into the first portion 11 thereof is achieved and controlled by the swirl characteristics of the first portion 11 as it leaves the swirler vanes 38. Modification of the mixing rate can be achieved by alteration of the geometry of the swirler vanes 38.

In accordance with the present invention, first flow control means are provided for regulating the flow of the first portion 11 of the process gas through duct 40 in response to flow rate of auxilary fuel so as to control the ratio of fuel flow to the first process gas stream flow. By controlling said ratio, the combustion of the auxiliary fuel in the first process gas stream to establish the flame 28 can be optimized to attain higher fuel efficiency and stable ignition.

Additionally, second flow control means are provided for regulating the flow of the second portion 13 of the process gas stream through the second gas inlet duct 60 in response to the difference in gas pressure between the gas supply duct 22 and the combustion chamber 18. The second flow control means respond so as to maintain a constant static pressure differential between the supply duct 22 at a location upstream of the splitting of the process gas stream 3 into a first and a second portion and the combustion chamber 18.

In the best mode presently contemplated for carrying out the invention as shown in the drawing, the first flow control means comprises a first gas damper 42 disposed within the first gas inlet duct 40 intermediate the process gas supply duct 22 and the primary air conduit 34 of the burner assembly 30, fuel flow rate sensing means 52 for sensing the flow rate of auxiliary fuel 9 to the burner assembly and generating a signal indicative of the fuel flow rate, and first damper drive means 44 operatively associated with the first gas flow damper 42 for selectively positioning the first gas flow damper within the first gas inlet duct 40 in response to the signal generated by the fuel flow rate sensing means 52.

As shown in the drawing, the second flow control means preferably comprises a second gas damper 62 disposed within the second gas inlet duct 60 intermediate the process gas supply duct 22 and the inlet plenum 14, pressure sensing means 70 for sensing and generating a signal 71 indicative of the pressure differential between the supply duct and the combustion chamber 18, and second damper drive means 64 operatively associated with the second gas flow damper 62 for selectively positioning the second gas flow damper within the second gas inlet duct in response to the pressure differential signal.

The pressure sensing means 70 preferably comprises a first static pressure sensor 72 disposed in the supply duct 22 at a location upstream of the splitting of the process gas stream 3 into first and second portions and a second static pressure sensor 74 disposed in the combustion chamber 18. The pressure differential sensing means 70 receives pressure measurements from each of the pressure sensors 72 and 74 and generates a signal 71 indicative of the pressure differential therebetween.

In operation, the process gas stream to be incinerated is conveyed through supply duct 22 to the housing 12 of the incinerator 10 under the influence of a forced draft fan (not shown) disposed upstream of the housing inlet 24 or an induced draft fan (not shown) disposed downstream of the outlet plenum 16. As the process gas stream enters the housing 12, it is split into a first portion 11 and a second portion 13.

The first portion 11 of the process gas is passed through inlet duct 40 and the primary air conduit 34 of the burner assembly 30 to mix with the auxiliary fuel 9. The second portion 13 of the process gas is passed through inlet duct 60 to the inlet plenum 14 and thence through baffle plate means 36 to mix with and be incinerated in flame 28 within combustion chamber 18.

The control of the operation of the incinerator 10 is attained through the gas flow dampers 42 and 62, and the controllers 50 and 80. A signal 53 indicative of fuel flow rate is sent from flow sensing means 52 to flow controller 50. In response thereto, controller 50 generates and transmits a signal 51 to the first damper drive means 44 to selectively position the first gas flow damper 42 within the first gas inlet duct 40 to maintain a desired ratio of fuel flow to the flow of the first process gas stream 11.

Additionally, pressure differential controller 80 receives a pressure differential signal 71 from the pressure sensing means 70. In response thereto, controller 80 generates and transmits a signal 81 to the second damper drive means 64 to selectively position the second gas flow damper 62 within the second gas inlet duct 60 to maintain a desired pressure differential between the process gas supply duct 22 and the combustion chamber 18.

In the aforedescribed manner, the existence of a stable flame 28 is ensured as control is maintained simultaneously over the fuel to oxidizer, i.e., the first process gas stream 11, ratio and over the driving force behind the first process gas stream, that is the pressure differential between supply 22 and the combustion chamber 18. If the pressure differential becomes to low, inadequate mixing of fuel and oxidizer would exist possibly resulting in a flame out. If the pressure differential becomes to high, the velocity of the first process gas stream could become to great and, in effect, blow the flame out. The fuel to oxidizer ratio must be controlled to ensure stable ignition and good fuel economy.

In a further aspect of the present invention, temperature sensing means 90 is provided to sense the surface temperature of the mixing plate means 36 and generate a signal indicating that the temperature of the mixing plates means has reached certain upper limits. In practice, at least one temperature sensor 92, such as a thermocouple is mounted on the mixing plate means 36 to monitor the surface temperature of the mixing plate means 36. A signal 93 indicative of surface temperature is sent from the temperature sensor 92 to temperature sensing means 90. In response thereto, the temperature sensing means 90 generates and transmits a control signal 91 to controller 94 indicating whether the sensed surface temperature has reached either a first upper temperature limit or a second upper temperature limit which is still higher than the first upper temperature limit.

If the control signal 91 indicates a surface temperature at or above the first upper temperature limit but below the second upper temperature limit, the controller 94 will generate and transmit an override control signal 95 to controller 50. In response thereto, controller 50 will actuate the first damper drive means 44 to further open the damper 42 thereby permitting increased flow of the first process gas stream to the burner assembly 30 so as to reduce flame temperature.

If the control signal 91 indicates a surface temperature at or above the second upper temperature limit, the controller 94 will generate and transmit a control signal 97 to close down fuel valve 98 thereby shutting off fuel flow to the incinerator 10 before the mixing plate means 36 is damaged by excessive temperature.

Although the present invention has been described in detail herein with reference to the best mode presently contemplated by the inventors as shown in the drawing, it will be appreciated by those skilled in the art that the present invention may be readily adapted, with or without modification, without departing from the true spirit and scope of the present invention as defined in the claims appended hereto.

We claim:

1. A fume incinerator for eliminating combustible fumes from an oxygen bearing process gas stream comprising:

a. a housing defining therein a gas inlet plenum, a gas outlet plenum, and a combustion chamber therebetween;

b. a burner assembly disposed axially within the housing between the inlet plenum and the combustion chamber, the burner assembly including a central fuel pipe for feeding auxiliary fuel to the combustion chamber, a primary air conduit opening into the combustion chamber and disposed coaxially about the central fuel feed pipe, and perforated mixing plate means disposed about the primary air conduit between the inlet plenum and the combustion chamber;

c. a process gas stream supply duct for conveying the process gas to be incinerated to the housing;

d. a first gas inlet duct interconnecting the supply duct to the primary air conduit for conveying a first process gas stream to the combustion chamber through the primary air conduit;

e. a second gas inlet duct interconnecting the supply duct to the inlet plenum for conveying a second process gas stream to the combustion chamber through the perforated mixing plate means;

f. first flow control means for regulating the flow of process gas through the first gas inlet duct in response to the flow rate of auxiliary fuel so as to control the ratio of fuel flow to first process gas stream flow; and g. second flow control means for regulating the flow of process gas through the second gas inlet duct in response to the difference in gas pressure between the process gas stream supply duct and the combustion chamber so as to maintain a constant static pressure differential therebetween.

2. A fume incinerator as recited in claim 1 wherein said first flow control means comprises:

a. a first gas flow damper disposed within the first gas inlet duct intermediate the process gas supply duct and the primary air conduit of the burner assembly;

b. fuel flow rate sensing means for sensing the flow rate of auxiliary fuel to the burner assembly and generating a signal indicative of the fuel flow rate; and c. first damper drive means operatively associated with the first gas flow damper for selectively positioning the first gas flow damper within the first gas inlet duct in response to the signal generated by the fuel flow rate sensing means so as to control the ratio of fuel flow to the first primary gas stream flow.

3. A fume incinerator as recited in claims 1 or 2 wherein said second flow control means comprises:

a. a second gas flow damper disposed within the second gas inlet duct intermediate the process gas supply duct and the inlet plenum;

b. pressure sensing means for sensing the static pressure within the process gas supply duct and the static pressure within the combustion chamber and generating a control signal indicative of the pressure differential therebetween; and c. second damper drive means operatively associated with the second gas flow damper for selectively positioning the second gas flow damper within the second gas inlet duct in response to the control signal generated by the pressure sensing means so as to maintain the static pressure differential therebetween at a constant.

4. A fume incinerator as recited in claim 3 further comprising temperature sensing means for sensing the surface temperature of the mixing plates means of the burner assembly and generating an override control signal for transmission to the first damper drive means operatively associated with the first gas flow damper whenever a preselected upper temperature limit is reached thereby overriding the control signal from the fuel flow rate sensing means and causing the first gas flow damper to further open so as to cause the flow of the first process gas stream to increase.

5. In a fume incinerator for eliminating combustible fumes from an oxygen bearing process gas stream of the type having a housing defining wherein a gas inlet plenum, a gas outlet plenum, and a combustion chamber; and a burner assembly including an axially disposed fuel pipe for feeding auxiliary fuel to the combustion chamber, a primary air conduit surrounding the fuel pipe and opening into the combustion chamber, and a perforated mixing plate means disposed about the primary air conduit between the inlet plenum and the combustion chamber; a method of operating said incinerator comprising:

a. feeding auxiliary fuel to the combustion chamber through the fuel pipe of the burner assembly;

b. splitting the process gas stream to be incinerated into a first and a second portion;

c. mixing the first portion of the process gas stream with the fuel passing into the combustion chamber thereby establishing a flame therein;

d. passing the second portion of the process gas stream into the combustion chamber from the gas inlet plenum through the perforated mixing plate means;

e. controlling the flow rate of the first portion of the process gas stream in response to fuel feed rate; and f. controlling the flow rate of the second portion of the process gas stream in response to the difference in gas pressure between a location in the process gas stream prior to splitting the process stream and a location in the combustion chamber so as to maintain a constant static pressure differential therebetween.

6. A method as recited in claim 5 further comprising:

a. sensing the surface temperature of the mixing plate means of the burner assembly;

b. comparing the sensed surface temperature to a first upper temperature limit; and c. increasing the flow of the first portion of the process gas whenever the sensed surface temperature reaches the first upper temperature limit.

7. A method as recited in claim 6 further comprising:

a. comparing the sensed surface temperature to a second upper temperature limit, the second upper temperature limit being at a higher temperature than the first upper temperature limit; and b. terminating the feeding of auxiliary fuel to the combustion chamber whenever the sensed surface temperature reaches the second upper temperature limit.

* * * * *